US007150820B2

(12) United States Patent
Hu et al.

(10) Patent No.: US 7,150,820 B2
(45) Date of Patent: Dec. 19, 2006

(54) THIOUREA- AND CYANIDE-FREE BATH AND PROCESS FOR ELECTROLYTIC ETCHING OF GOLD

(75) Inventors: Zhongmin Hu, Kalispell, MT (US); Eric J. Young, Boise, ID (US)

(73) Assignee: Semitool, Inc., Kalispell, MO (US)

( * ) Notice: Subject to any disclaimer, the term of this patent is extended or adjusted under 35 U.S.C. 154(b) by 308 days.

(21) Appl. No.: 10/667,795

(22) Filed: Sep. 22, 2003

(65) Prior Publication Data

US 2005/0061683 A1 Mar. 24, 2005

(51) Int. Cl.
*H05K 3/07* (2006.01)
*C25F 3/02* (2006.01)

(52) U.S. Cl. ..... 205/684; 205/667; 205/674

(58) Field of Classification Search ..... 205/674, 205/667, 684
See application file for complete search history.

(56) References Cited

U.S. PATENT DOCUMENTS 3,314,869 A * 4/1967 Maddocks et al. ..... 216/16
3,663,388 A * 5/1972 Hedman, Jr. ..... 205/666
3,935,005 A 1/1976 Solidum et al.
4,142,953 A 3/1979 Lovelace
4,144,090 A 3/1979 Franz
4,192,729 A 3/1980 Cancelleri et al.
4,208,378 A 6/1980 Heinen et al.
4,243,532 A 1/1981 Tsuda et al.
4,285,784 A 8/1981 Flinn et al.
4,303,482 A 12/1981 Bühne et al.
4,324,626 A 4/1982 McGivern, Jr.
4,358,352 A 11/1982 Rhoda
4,385,971 A 5/1983 Swartz
4,427,502 A 1/1984 Abys
4,430,178 A 2/1984 Anderson et al.
4,483,789 A 11/1984 Kunze et al.
4,750,977 A 6/1988 Marrese
5,096,550 A 3/1992 Mayer et al.
5,127,207 A 7/1992 Cunningham
5,221,421 A 6/1993 Leibovitz et al.
5,232,328 A 8/1993 Owczarz et al.
5,304,359 A 4/1994 Duyvesteyn et al.
5,310,475 A 5/1994 Kitada et al.
5,338,416 A 8/1994 Mlcak et al.
5,344,491 A 9/1994 Katou (Continued)

FOREIGN PATENT DOCUMENTS

WO WO 98/02909 A1 1/1998

OTHER PUBLICATIONS

Moffat, T.P., et al., "Superconformal Electrodeposition of Copper in 500-90 nm Features," *Journal of The Electrochemical Society* 147(12):4524-4535, 2000.

(Continued)

*Primary Examiner*—Roy King
*Assistant Examiner*—Michael P. Alexander
(74) *Attorney, Agent, or Firm*—Christensen O'Connor Johnson Kindness PLLC

(57) ABSTRACT

An aqueous thiourea-free gold etching bath for electrolytically etching gold from a microelectronic workpiece. One embodiment of the aqueous thiourea-free bath contains: (a) about 0.5–1.5 M iodide; (b) about 0.1–0.3 M sulfite; and (c) about 1.0–3.0 g/L wetting agent. The bath is useful in a process for electrolytically etching gold from a microelectronic workpiece. A tool system in which the baths and processes of the present invention may be used is also described.

13 Claims, 3 Drawing Sheets

U.S. PATENT DOCUMENTS

| | | | |
|---|---|---|---|
| 5,380,400 | A | 1/1995 | Abys et al. |
| 5,421,991 | A | 6/1995 | Yarita |
| 5,464,509 | A | 11/1995 | Mlcak et al. |
| 5,484,518 | A | 1/1996 | Goldberg |
| 5,494,560 | A | 2/1996 | Arimoto et al. |
| 5,529,680 | A | 6/1996 | Kitada et al. |
| 5,556,812 | A | 9/1996 | Leuschner et al. |
| 5,620,581 | A | 4/1997 | Ang |
| 5,620,583 | A | 4/1997 | Kuhn et al. |
| 5,630,932 | A | 5/1997 | Lindsay et al. |
| 5,641,391 | A | 6/1997 | Hunter et al. |
| 5,731,678 | A | 3/1998 | Zila et al. |
| 5,789,320 | A | 8/1998 | Andricacos et al. |
| 5,863,412 | A | 1/1999 | Ichinose et al. |
| 5,985,126 | A | 11/1999 | Blek et al. |
| 6,080,291 | A | 6/2000 | Woodruff et al. |
| 6,083,710 | A | 7/2000 | Heller et al. |
| 6,103,096 | A | 8/2000 | Datta et al. |
| 6,121,009 | A | 9/2000 | Heller et al. |
| 6,139,716 | A | 10/2000 | McCarthy et al. |
| 6,174,425 | B1 | 1/2001 | Simpson et al. |
| 6,179,990 | B1 | 1/2001 | Galasco et al. |
| 6,203,582 | B1 | 3/2001 | Berner et al. |
| 6,359,328 | B1 | 3/2002 | Dubin |
| 6,491,806 | B1 | 12/2002 | Dubin et al. |
| 2001/0015321 | A1 | 8/2001 | Reid et al. |
| 2002/0036145 | A1 | 3/2002 | Dubin et al. |
| 2002/0074234 | A1 | 6/2002 | Dubin et al. |
| 2002/0074238 | A1 | 6/2002 | Mayer et al. |
| 2002/0084191 | A1 | 7/2002 | Haba et al. |

OTHER PUBLICATIONS

Moffat, T.P., et al., "Superconformal Electrodeposition of Copper," *Electrochemical and Solid-State Letters* 4(4):C26-C29, 2001.

Wheeler, D., et al., "Modeling Superconformal Electrodeposition Using the Level Set Method," *Journal of The Electrochemical Society* 150(5):C302-C310, 2003.

* cited by examiner

THIOUREA- AND CYANIDE-FREE BATH AND PROCESS FOR ELECTROLYTIC ETCHING OF GOLD

FIELD OF THE INVENTION

The invention is in the field of electrolytical etching of gold (symbol Au) from a microelectronic workpiece in an etching bath. More particularly, the invention relates to electrolytically etching gold from a microelectronic workpiece in an etching bath that is free of the suspected carcinogen, thiourea.

BACKGROUND OF THE INVENTION

In the semiconductor industry, particularly in the segment of the semiconductor industry focused on communication applications, gold is widely used as a conductive material. When gold is used to form conductive features, a thin layer of gold is frequently deposited and employed as a seed layer. Subsequently, for example, after electrolytic deposition, certain portions of the gold seed layer are no longer desired and thus need to be removed from the semiconductor workpiece.

Both wet-etching and electrolytic etching can be used to remove a gold seed layer from semiconductor workpieces. One wet-etching process is disclosed in U.S. Pat. No. 5,221,421 to Leibovitz et al. One disadvantage associated with a wet-etch process is that it can produce levels of surface roughness on the gold features that are considered undesirable by manufacturers of semiconductor devices. Another disadvantage of a wet-etch process is that it results in undercutting around the base of the gold features. Undercutting of the gold features is undesirable because it compromises the mechanical strength and electrical properties of the features. In addition, the wet-etching process conditions need to be strictly controlled. For example, small variations in temperature and/or reagent concentration significantly affect the amount of gold removed. This problem may result in over-removal and over-undercutting.

To this end, an electrolytic process is easier to control and is advantageous over a wet-etching process. Both thiourea and cyanide have been used in commercial baths and processes for electrolytically etching gold from a semiconductor workpiece. The problem associated with the process using thiourea is that thiourea is a suspected human carcinogen. Cyanide is a very poisonous chemical exposure to which harms the brain and heart. Thiourea and cyanide pose potential health and safety risks in the workplace. Moreover, disposal of a thiourea-containing and cyanide-containing bath presents an environmental hazard.

Accordingly, the primary advantage of the present invention is that it electrolytically removes gold without the use of thiourea or cyanide.

SUMMARY OF THE INVENTION

The present invention provides a bath and process for electrolytically etching gold in a safe and effective manner using materials not generally considered to be hazardous. In one embodiment, the bath includes iodide, sulfite, a wetting agent, and water, and is free of thiourea and cyanide. In another embodiment, the bath includes chlorides, a wetting agent, and water, and is also free of thiourea and cyanide. The baths are useful in a process for electrolytically etching gold in the absence of the suspected carcinogen thiourea or the poisonous chemical cyanide. The process is effective at removing gold from a substrate, in some embodiments, leaving no residual gold at the microscopic level. In addition, the present invention etches gold with little undercutting of the features that remain after the etching and without producing an undesirable amount of surface roughness on the remaining gold features.

One embodiment of the present invention is an aqueous thiourea-free electrolytic etching bath that includes (a) about 0.1–3.0 M iodide; (b) about 0.01–1.0 M sulfite; and (c) about 0.1–5.0 g/L wetting agent.

In another embodiment of the present invention, the aqueous thiourea-free electrolytic etching bath includes about 1 to 6 M chloride and about 0.1–5.0 g/L wetting agent.

In another embodiment, the invention is a process for electrolytically etching gold from a microelectronic workpiece, the process including steps of (a) providing an aqueous electrolytic etching bath free of thiourea and cyanide; (b) providing a microelectronic workpiece having some amount of gold thereon; (c) contacting the gold with the etching bath; and (d) providing an electric current flow between the gold and a cathode disposed in electrical contact with the bath, whereby at least a portion of the gold is removed from the microelectronic workpiece. Examples of gold etching baths free of thiourea and cyanide are described above.

In another embodiment of the present invention, the invention is a tool system for electrolytically etching gold from a microelectronic workpiece. The tool system includes one or more stations for carrying out the following functions (a) receiving a microelectronic workpiece having some amount of gold thereon; (b) providing an etching bath free of thiourea and cyanide for electrolytically etching gold; (c) contacting the gold with the etching bath; (d) providing electric current flow between the gold feature and a cathode disposed in electrical contact with the etching bath; (e) removing at least a portion of the gold from the microelectronic workpiece; (f) rinsing residual chemistry from the microelectronic workpiece; and (g) drying the microelectronic workpiece.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying figures.

DETAILED DESCRIPTION OF THE PREFERRED EMBODIMENTS

Figure 1A:
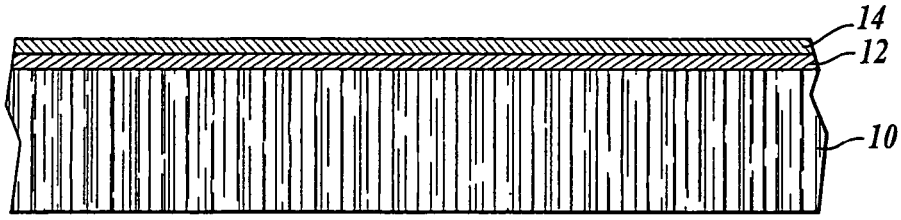
FIGS. 1A–1F schematically illustrate a process for forming a gold feature employing the gold etching bath and process of the present invention.
Figure 1B:
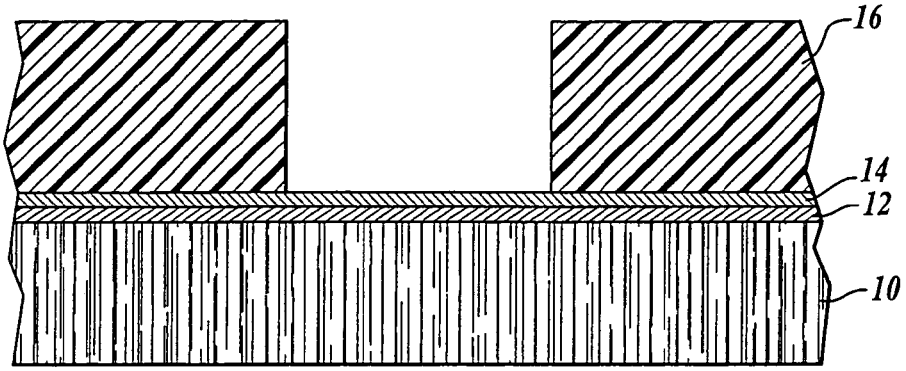

As used throughout the specification, the following abbreviations and symbols have the following meanings, unless the context clearly indicates otherwise: GaAs=gallium arsenide; Å=angstrom; Å/min=angstroms per minute; μm=micrometer; M=molarity; g/L=grams per liter; and ml/L=milliliters per liter.

The term "etching" refers to the electrolytic removal of gold, unless the context clearly indicates otherwise. Electrochemical deposition refers to both electrolytic deposition and electroless deposition. "Anode" refers to the electrode at which electrolytic oxidation occurs. "Cathode" refers to the electrode at which electrolytic reduction occurs. The term "undercutting" refers to the undesirable result where gold is etched away along the base of a feature, thereby creating a notch or undercut along the base of the feature. The term "wetting agent" refers to an organic compound that reduces the surface tension of the bath and that serves as a wetting agent. The term "PEG" refers to polyethylene glycol.

As used herein, the term "microelectronic workpiece" or "workpiece" is not limited to semiconductor wafers, but rather refers to workpieces having generally parallel planar first and second surfaces, that are relatively thin, including semiconductor wafers, ceramic workpieces, and other workpieces upon which microelectronic circuits or components including submicron features, data storage elements or layers, and/or micromechanical elements are formed.

As discussed above, the present invention relates to a thiourea-free gold etching bath, free of suspected carcinogens and processes using such baths that are effective to etch gold from the surface of microelectronic workpieces. In an application where gold seed layers are to be etched using the baths and processes of the present invention, in some embodiments the baths and processes of the present invention are able to remove the gold seed layers completely, such that when specimens are observed under a scanning electron microscope (SEM), no residual gold is observable on areas where the gold seed layer was removed. Etching of the gold seed layers in accordance with the present invention can be achieved without imparting undesirable amounts of surface roughness (e.g., $R_a$ greater than 150 angstroms) to features that remain after the etching process. In addition to the above, etching gold seed layers using the baths and processes of the present invention can be carried out without undercutting gold features that are intended to remain on the surface of the microelectronic workpiece after the gold seed layer has been removed. Exemplary baths and processes are described below.

Thiourea and Cyanide-Free Electrolytic Etching Baths

One embodiment of an electrolytic etching bath of the present invention is an aqueous bath including iodide ($I^-$), sulfite ($SO_3^{2-}$), and a wetting agent.

In this bath, iodide functions as a complexing agent. Sulfite is present as a sacrificial stabilizer and pH buffering species. The wetting agent promotes wetting of the surface of the workpiece that functions as the anode. Through normal operation of the bath, sulfite will be oxidized requiring regular replenishment to ensure the stability of the bath. Replenishment of sulfite should be based on regular analysis results. In addition to maintaining the sulfite concentration, the pH of the solution must be monitored and maintained to ensure proper operation and stability of the bath. Baths of the preferred concentration range described below have lives on the order of greater than 15 amp-min/liter, e.g., 20 amp-min/liter to 35 amp-min/liter.

Iodide

The source of iodide is a water-soluble salt that dissociates in water to produce $I^-$. Examples of such water-soluble salts are: lithium iodide (LiI); lithium iodide trihydrate ($LiI.3H_2O$); sodium iodide (NaI); sodium iodide dihydrate. ($NaI.2H_2O$); ammonium iodide ($NH_4I$); and potassium iodide (KI). Suitable gold etching results have been achieved using KI. The concentration of iodide may be a molarity of about 0.1–3.0. A narrower molarity range is about 0.5–1.5. Suitable gold etching results have been achieved with a molarity of about 1.0.

Sulfite

The source of sulfite is a water-soluble salt that dissociates in water to produce sulfite ($SO_3^{2-}$) and/or bisulfite ($HSO_3^-$), depending on the pH of the solution. Examples of such water-soluble salts are: lithium sulfite monohydrate ($Li_2SO_3.H_2O$); sodium sulfite ($Na_2SO_3$); sodium sulfite hepta-hydrate ($Na_2SO_3.7H_2O$); sodium bisulfite ($NaHSO_3$); potassium sulfite ($K_2SO_3$); and potassium sulfite dihydrate ($K_2SO_3.2H_2O$). Suitable gold etching has been achieved using $Na_2SO_3$. The concentration of sulfite may be a molarity of about 0.01–1.0. A narrower molarity range is about 0.1–0.3. Suitable gold etching has been achieved with a molarity of about 0.2.

Around pH 7.2, both $SO_3^{2-}$ and $HSO_3^-$ are present in solution. The relative concentration of these two species is determined by the solution pH. The use of sodium bisulfite (or sodium hydrogensulfite), together with sodium hydroxide, is equivalent to the use of sodium sulfite.

Wetting Agent

A wetting agent is employed in the etching bath. A wide variety of known nonionic and ionic wetting agents may be employed. One example is commercially available polyethylene glycol polymers. Suitable gold etching has been achieved using polyethylene glycol polymers having an average molecular weight ranging between about 2,000 and about 35,000. The concentration of wetting agent may be about 0.01–5.0 g/L, depending on the species used. A narrower range of wetting agent concentration is about 1.0–3.0 g/L. Suitable etching has been achieved with a concentration of about 3.0 g/L.

One particular etching bath of the invention is shown in the following Table 1.

TABLE 1

| Component | Concentration g/L | Concentration M |
|---|---|---|
| KI | 166 | 1 |
| $Na_2SO_3$ | 25 | 0.2 |
| Wetting agent | 3 | — |
| Water | Balance | — |

In another embodiment, an electrolytic etching bath of the present invention is an aqueous bath containing chloride ($Cl^-$) and a wetting agent.

One primary source of chloride is hydrochloric acid. Chloride-containing salt such as sodium chloride and ammonium chloride can also serve as a source of chloride; however, the solution of the salts must first be acidified by adding acids such as sulfuric acid. Useful wetting agents include those described above in the context of the iodide and sulfite-containing baths. Sodium dodecylsulfate is also a useful wetting agent. The concentration of sodium dodecylsulfate in the bath can vary from about 0.01 g/liter to about 1 g/liter. The concentration of chloride in the baths may be a molarity of about 1 to about 6.

The chloride-containing gold etching baths are not as effective as the iodide/sulfite-containing baths in removing gold from a substrate down to a microscopic level. The chloride-containing bath nonetheless is useful in applications where removal of gold down to the microscopic level is unnecessary.

Effective etching of gold is achieved by contacting the gold features with the chloride-containing gold etching bath under the conditions described below with respect to an electrolytic gold etching process. For the chloride-containing etching bath, the pH is maintained acidic in order to achieve effective etching of the gold.

One Particular Bath Makeup Procedure

One particular non-limiting bath makeup procedure to achieve the concentrations in the above Table 1 is as follows. For each liter of bath, weigh out 25 g sodium sulfite and dissolve it in about 0.7 L water, adjust the pH to 7.0–7.4 with acids such as sulfurous acid and/or sulfuric acid.

The next step is to add 166 g of KI and 3 g polyethylene glycol (PEG with an average molecular weight of about 20,000) to the above solution.

The next step is to stir to dissolve the KI and then add water to make a final volume of 1 liter.

Finally, transfer the bath to an opaque container and keep it airtight for storage and transportation. If a yellowish color develops after long-term storage, sodium sulfite (e.g., 20 g/L) should be added and the bath pH adjusted to 7.0–7.4 prior to use.

Electrolytic Gold Etching Processes

In the process aspect of the present invention, an electrolytic etching bath (as described above) free of thiourea and cyanide for etching gold from a semiconductor workpiece is used. In one embodiment of a process of the present invention, the microelectronic workpiece is a GaAs wafer or a silicon wafer, which has been processed to have thereon gold features, a gold seed layer, and an underlying conductive layer of barrier materials such as titanium/titanium nitride, tantalum/tantalum nitride, and titanium/tungsten. The anode is the electrically-conductive surface of the workpiece. The cathode is preferably an inert cathode. An exemplary inert cathode is a platinized titanium cathode. The process can be carried out in a plating reactor of conventional design operated in etching mode. Specific process parameters and ranges of process parameters are set forth in Table 2 below.

TABLE 2

| Parameter | Specific | Range |
|---|---|---|
| Temperature | 25° C. | 20–30° C. |
| pH | 7.2 | 6.4–8 |
| Current density (mA/cm2) | 1.5 | 0.1–10 |
| Current | DC | |
| Nitrogen purge and blanket | Preferred | |
| Quiescence (no flow and purge) when reactor idles | Preferred | |

A wide pH range outside 6.4–8.0 is operable. However, a pH close to 7.2 is preferred. The complexing ability of iodide is not affected by pH over a wide pH range; however, the stability of iodide itself, and thus the consumption of sulfite, is dependent on pH. At a pH approaching neutral, the bath is significantly more stable than at an acidic pH. In addition, at a pH approaching pH 7.2, the solution pH is buffered by the $HSO_3^-/SO_3^{2-}$ couple. The pH of the solution should be monitored on a daily basis using a standard pH electrode at room temperature.

A current density from 0.1 mA/cm$^2$ to 10 mA/cm$^2$ is operable. A current density from 1 mA/cm$^2$ to 3 mA/cm$^2$ is preferred. A current density of 3 mA/cm$^2$ may be used to etch a thicker gold seed layer (e.g., a gold seed layer of about 1500 Å thickness). A current density of 1.5 mA/cm$^2$ has been found to be a judicious choice for etching thinner features, e.g., a 500 Å gold seed layer. At such a current density, the etching of a 500 Å gold seed layer is completed in about 70 seconds.

An exemplary power supply for the process provides up to 10 volts at an average current of 5 amps or higher.

Etching endpoint detection can be used during the gold etching process. The etching endpoint is determined by monitoring the current/voltage characteristics of the electrochemical cell.

As indicated in Table 1 above, a nitrogen purge and a nitrogen blanket are preferred in order to reduce the consumption of sulfite and prolong the bath life. Quiescence (no flow and no purge) when the reactor is idle is preferred in order to reduce the consumption of sulfite and prolong the bath life.

An exemplary mode of etching is to rotate the workpiece in an etching reactor at a speed of about 10–100 revolutions per minute with an etching bath as described above impinging against the workpiece at a flow rate of about 1–6 gallons per minute. For 100-mm wafers, an exemplary flow rate is about 3.5 gallons per minute. For 125-mm wafers, an exemplary flow rate is about 4 gallons per minute. For 150-mm and 200-mm wafers, an exemplary flow rate is about 5.5 gallons per minute. Other modes may also be used.

Comparative testing has been conducted between the prior thiourea-containing bath and a bath of the present invention. The tests measured the line resistance of a gold feature and the current leakage between adjacent gold features on wafers processed using the thiourea-containing bath and using a thiourea and cyanide-free bath of the present invention. The test results in Table 3 below show that the thiourea-free bath of the present invention is equal or superior to the prior thiourea-containing bath.

TABLE 3

| | Leakage current | | Line resistance | |
|---|---|---|---|---|
| Solution (bath) | Average | Std. dev. | Average | Std. dev. |
| Thiourea-containing bath | 7.08E−07 | 2.0E−07 | 100.6 | 1.4 |
| Thiourea-free bath | 1.48E−07 | 1.1E−07 | 99.3 | 2.2 |

Bath Control

In order to control the pH of the bath, 5% (v/v) sodium hydroxide solution can be used to raise bath pH and 5% (v/v) sulfurous acid or 5% (w/v) sodium bisulfite solution to lower pH. 5% (v/v) sulfuric acid may be used as an alternative to sulfurous acid and sodium bisulfite solutions.

Sulfite concentration in the bath can be determined by iodimetry and should be properly controlled within the concentration ranges described above.

Figure 1C:
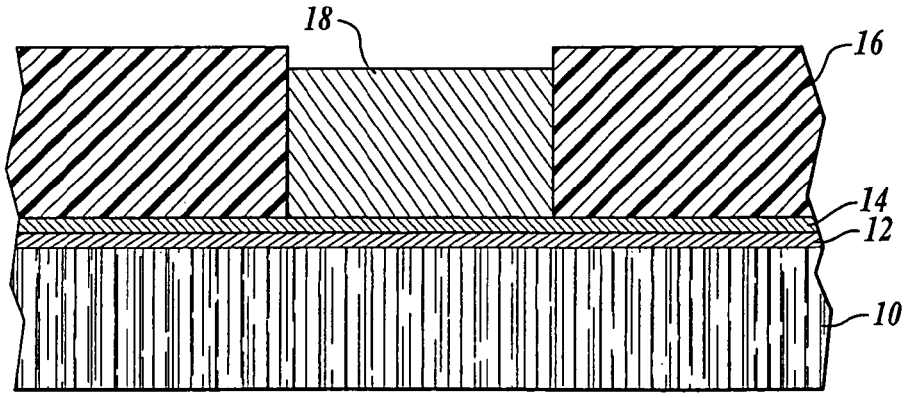
Figure 1D:
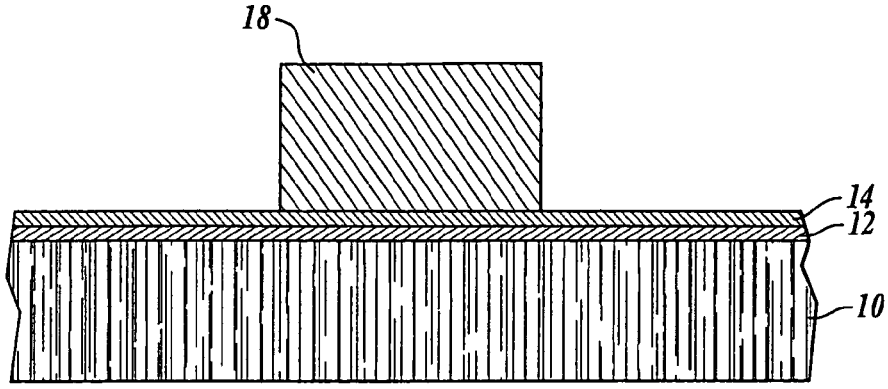
Figure 1E:
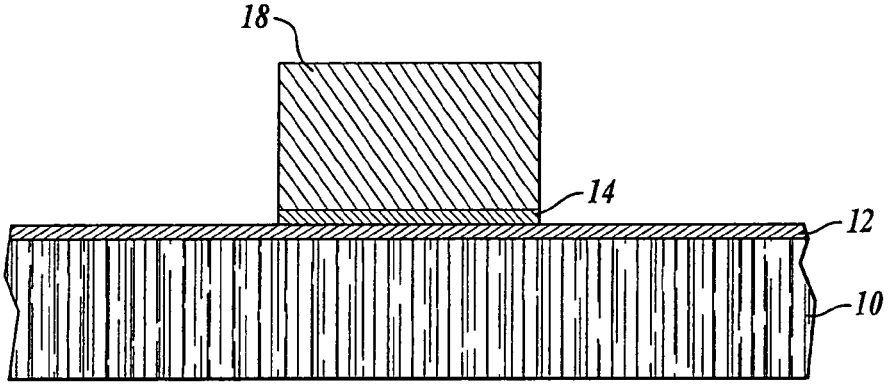
Figure 1F:
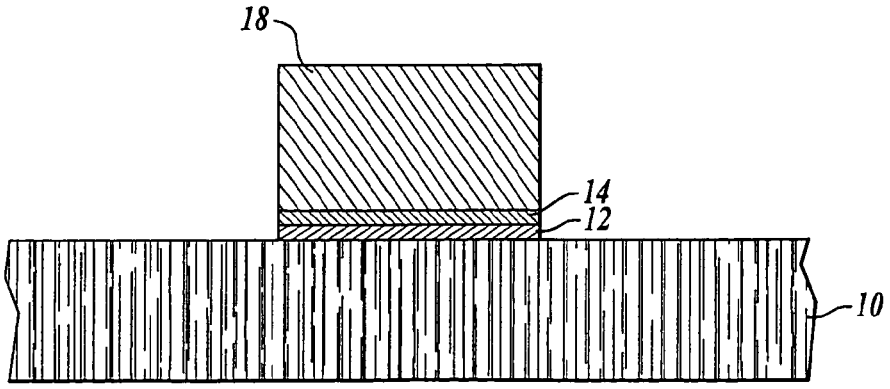

An example of an application of the gold etching baths and the gold etching processes of the present invention include formation of gold features on semiconductor wafers. Referring to FIG. 1A, a semiconductor substrate 10 is provided with an adhesion/barrier layer 12, e.g., titanium/tungsten. Overlying barrier layer 12 is a conductive seed layer 14, e.g., gold. In accordance with conventional processes, a photoresist 16 is deposited onto conductive seed layer 14 and patterned to expose portions of conductive seed layer 14. In FIG. 1C, gold feature 18 is electrochemically deposited onto the exposed portion of seed layer 14. Thereafter, as illustrated in FIG. 1D, photoresist 16 is removed. The gold etching bath and processes of the present invention can then be used to etch away the exposed portion of conductive seed layer 14 when such layer is comprised of gold as illustrated in FIG. 1E. Subsequent to the removal of the gold seed layer 14, that is not covered by gold feature 18, the exposed portions of barrier layer 12 are removed as illustrated in FIG. 1F.

Tool System

The foregoing process for forming gold features may be suitably carried out in commercially available apparatus, which are arranged and have controllers that are then modified to be programmed to carry out pre-deposition treatments, deposition, etching, and post-etching treatments. One suitable tool system for implementing the present invention is the LT210™ tool system available from Semitool, Inc. of Kalispell, Mont., and as further described in U.S. Pat. No. 6,203,582 to Berner et al. assigned to Semitool, Inc., the disclosure of which is hereby expressly incorporated by reference. Other commercially available tool systems such as the Equinox® or Paragon® model tools available from Semitool, Inc. are also suitable for use in practicing the present invention as well as systems offered by other manufacturers.

In general, the tool system includes a plurality of workstations for carrying out different operations. The various workstations are controlled by a controller.

Figure 2:
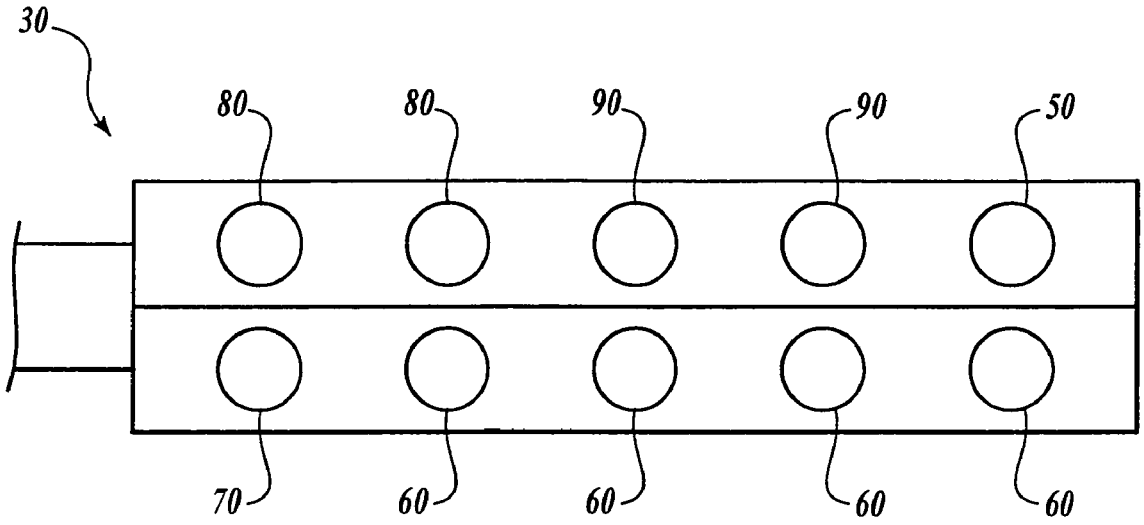
FIG. 2 is schematic plan view of a tool useful for carrying out the process described with reference to FIG. 1.

FIG. 2 is a schematic representation of a suitable tool system 30 for forming gold features on the surface of a microelectronic workpiece, such as a semiconductor wafer. The tool system 30 may include a plurality of workstations 50, 60, 70, 80, and 90. Workpieces are initially prepared for processing at one or more pre-treatment stations 50 which perform, for example, cleaning, prewetting, and rinsing steps. The workpiece is then passed to a station 60, in which the electrochemical deposition of gold is carried out. Following the electrochemical deposition of the gold feature and removal of the photoresist, for example, in workstation 70, the workpiece is delivered to workstation 80 where the gold etching process of the present invention is carried out using a gold etching bath formed in accordance with the present invention. After the gold etching process, the workpiece can be delivered to workstation 90 where post-etching processing occurs such as cleaning, rinsing, and drying the workpiece.

Electric power is supplied to the various workstations by a power supply. This power supply connects electrically between the surface of the microelectronic workpiece (which functions as the anode during etching) and the cathode that is located within the workstation and that is in contact with the gold etching bath. The power supply is capable of selectively supplying either a forward plating power or a reverse etching power, with both forward and reverse voltage and current control capabilities, although this is not required for electrolytic etching using a direct current power source.

The supply of reverse etching power is preferably automatically controlled by a programmable controller, which includes a central processing unit that operates in accordance with program code to cause the power supply to supply reverse power, at desired levels and for desired time periods in accordance with the present invention. Alternatively, the etching power can be provided by reversing the connections between the power supply and the reactor.

The controller may include a data input device (not shown), such as a keypad, touch screen, other user interface, or a floppy or CD disk drive. The tool may also include further workstations (not shown) for additional processing steps, as dictated by the workpiece being processed.

Unless indicated otherwise, in stating a numerical range for a compound or a temperature or a time or other process matter or property, such a range is intended to specifically designate and disclose the minimum and the maximum for the range and each number, including each fraction and/or decimal, between the stated minimum and maximum for the range. For example, a range of 1 to 10 discloses 1.0, 1.1, 1.2 . . . 2.0, 2.1, 2.2, . . . and so on, up to 10.0. Similarly, a range of 500 to 1000 discloses 500, 501, 502, . . . and so on, up to 1000, including every number and fraction or decimal therewithin. "Up to x" means "x" and every number less than "x", for example, "up to 5" discloses 0.1, 0.2, 0.3, . . . , and so on up to 5.0.

While the preferred embodiments of the invention have been illustrated and described, it will be appreciated that various changes can be made therein without departing from the spirit and scope of the invention.

The invention claimed is:

1. A process for electrolytically etching gold from a microelectronic workpiece, said process comprising steps of:

(a) providing an aqueous thiourea-free etching bath comprising:
  (1) about 0.5–1.5 M of iodide;
  (2) about 0.1–0.3 M of sulfite; and
  (3) about 1.0–3.0 g/L of wetting agent;

(b) providing a microelectronic workpiece having at least some amount of gold thereon;

(c) contacting the gold with the etching bath; and (d) providing an electric current flow between the gold and a cathode disposed in electrical contact with the bath, whereby at least a portion of the gold is removed from the microelectronic workpiece.

2. The process of claim 1, wherein a source of said iodide in said bath is selected from the group consisting of LiI, $LiI.3H_2O$, NaI, $NaI.2H_2O$, and KI.

3. The process of claim 1, wherein a source of said iodide in said bath is KI.

4. The process of claim 1, wherein the concentration of said iodide in said bath is about 0.9–1.1 M.

5. The process of claim 1,wherein a source of said sulfite in said bath is selected from the group consisting of $Li_2SO_3.H_2O$, $Na_2SO_3$, $Na_2SO_3.7H_2O$, and $K_2SO_3.2H_2O$.

6. The process of claim 1, wherein a source of said sulfite in said bath is $Na_2SO_3$.

7. The process of claim 1, wherein the concentration of said sulfite in said bath is about 0.18–0.22 M.

8. The process of claim 1, wherein the wetting agent in said bath is a polyethylene glycol.

9. The process of claim 1, wherein the wetting agent in said bath is a polyethylene glycol having an average molecular weight ranging from about 2,000 to about 35,000.

10. The process of claim 8, wherein the concentration of the wetting agent in said bath is about 2.7–3.3 g/L.

11. The process of claim 1, wherein the pH of said bath is about 6.4–8.0.

12. A process for electrolytically etching gold from a microelectronic workpiece, said process comprising steps of:

(a) providing an thiourea-free etching bath having a temperature of about 20–30° C., said bath comprising:

(1) about 0.9–1.1 M of iodide, wherein the source of iodide is selected from the group consisting of LiI, $LiI.3H_2O$, NaI, $NaI.2H_2O$, and KI;

(2) about 0.18–0.22 M of sulfite, wherein the source of sulfite is selected from the group consisting of $Li_2SO_3.H_2O$, $Na_2SO_3$, $Na_2SO_3.7H_2O$, and $K_23.2H_2O$;

(3) about 2.7–3.3 g/L of a polyethylene glycol; and (4) the balance is water;

(b) providing a microelectronic workpiece having at least some amount of gold thereon;

(c) contacting the gold with the etching bath;

(d) providing electric current flow between the gold and a cathode disposed in electrical contact with the bath; and (e) removing at least a portion of the gold from said microelectronic workpiece.

13. The process of claim 12, wherein the pH of said bath is about 6.4–8.0.

* * * * *

UNITED STATES PATENT AND TRADEMARK OFFICE

CERTIFICATE OF CORRECTION

PATENT NO. : 7,150,820 B2
APPLICATION NO. : 10/667795
DATED : December 19, 2006
INVENTOR(S) : Z. Hu et al.

It is certified that error appears in the above-identified patent and that said Letters Patent is hereby corrected as shown below:

| COLUMN | LINE | |
|---|---|---|
| Title Page, Item (73) Pg. 1, col. 1 | Assignee | "Kalispell, MO" should read --Kalispell, MT-- |
| 8 (Claim 2, line 3) | 46 | "LiI.3$H_2O$, NaI, NaI.2$H_2O$," should read --LiI•3$H_2O$, NaI, NaI•2$H_2O$,-- |
| 8 (Claim 5, line 3) | 53 | "$Li_2SO_3$.$H_2O$, $Na_2SO_3$, $Na_2SO_3$.7$H_2O$, and $K_2SO_3$.2$H_2O$." should read --$Li_2SO_3$•$H_2O$, $Na_2SO_3$, $Na_2SO_3$•7$H_2O$, and $K_2SO_3$•2$H_2O$.-- |
| 9 (Claim 12, line 8) | 8 | LiI.3$H_2O$, NaI, NaI.2$H_2O$," should read --LiI•3$H_2O$, NaI, NaI•2$H_2O$,-- |
| 9 (Claim 12, lines 11-12) | 11-12 | "$Li_2SO_3$.$H_2O$, $Na_2SO_3$, $Na_2SO_3$.7$H_2O$, and $K_2$3.2$H_2O$;" should read --$Li_2SO_3$•$H_2O$, $Na_2SO_3$, $Na_2SO_3$•7$H_2O$, and $K_2SO_3$•2$H_2O$;-- |

Signed and Sealed this

Fifteenth Day of May, 2007

JON W. DUDAS
*Director of the United States Patent and Trademark Office*